US009278041B2

(12) United States Patent
Riach

(10) Patent No.: US 9,278,041 B2
(45) Date of Patent: Mar. 8, 2016

(54) EXAMINATION TABLE

(75) Inventor: Jeffrey Riach, Cockeysville, MD (US)

(73) Assignee: Oakworks, Inc., New Freedom, PA (US)

( * ) Notice: Subject to any disclaimer, the term of this patent is extended or adjusted under 35 U.S.C. 154(b) by 461 days.

(21) Appl. No.: 13/316,919

(22) Filed: Dec. 12, 2011

(65) Prior Publication Data

US 2012/0186017 A1 Jul. 26, 2012

Related U.S. Application Data

(60) Provisional application No. 61/424,999, filed on Dec. 20, 2010.

(51) Int. Cl.

| | |
|---|---|
| ***A61G 13/08*** | (2006.01) |
| ***A61G 13/00*** | (2006.01) |
| *A61G 13/12* | (2006.01) |

(52) U.S. Cl.

CPC ..... *A61G 13/0018* (2013.01); *A61G 13/08* (2013.01); *A61G 13/1285* (2013.01); *A61G 13/1255* (2013.01); *A61G 2013/0072* (2013.01)

(58) Field of Classification Search

CPC ..... A61G 7/002; A61G 7/015; A61G 7/018; A61G 13/0018; A61G 13/08; A61G 7/07; A61G 7/0755; A61G 13/125; A61G 13/1255; A61G 13/1285; A61G 2013/0072

USPC ..... 5/613, 617, 618, 657, 937, 943, 621, 5/623, 646, 81.1 HS

See application file for complete search history.

(56) References Cited

U.S. PATENT DOCUMENTS

| | | | | | |
|---|---|---|---|---|---|
| 3,428,307 | A * | 2/1969 | Owen | A47B 1/02 108/138 |
| 3,751,028 | A | 8/1973 | Scheininger et al. | |
| 4,236,261 | A * | 12/1980 | Huempfner | 5/616 |
| 4,271,830 | A | 6/1981 | Moon | |
| 5,046,708 | A | 9/1991 | Schaefer | |
| 5,275,176 | A * | 1/1994 | Chandler | 5/613 |
| 5,926,876 | A * | 7/1999 | Haigh et al. | 5/617 |
| 6,367,104 | B1 * | 4/2002 | Falbo et al. | 5/601 |
| 6,804,846 | B2 * | 10/2004 | Schuerch | 5/635 |
| 6,907,625 | B2 * | 6/2005 | Nomura | 5/81.1 HS |
| 7,024,711 | B1 | 4/2006 | Stasney et al. | |
| 7,103,932 | B1 | 9/2006 | Kandora | |
| 7,636,967 | B1 | 12/2009 | Stokes | |
| 7,763,864 | B2 | 7/2010 | Formenti | |
| 8,001,633 | B2 * | 8/2011 | Swain, Jr. | 5/621 |
| 2009/0270236 | A1 | 10/2009 | Berc | |

* cited by examiner

*Primary Examiner* — Nicholas Polito
(74) *Attorney, Agent, or Firm* — Barley Snyder

(57) ABSTRACT

An examination table designed to provide a technician or practitioner easy access to various regions of a patient's body. Specifically, the examination table includes a lower support structure, an upper support structure, and an examination passageway. The upper support structure has a sliding access panel disposed on a side of the upper support structure such that the examination passageway is provided when the sliding access panel is repositioned at various measurements.

18 Claims, 3 Drawing Sheets

EXAMINATION TABLE

CROSS-REFERENCE TO RELATED APPLICATIONS

This application claims benefit of the filing date under 35 U.S.C. §119(e) of Provisional Patent Application No. 61/424,999, filed Dec. 20, 2010.

FIELD OF THE INVENTION

The invention relates to an examination table and in particular to an examination table having a sliding access panel.

BACKGROUND

There are several known exam tables which include access panels, which facilitate access by a technician or practitioner to the thoracic region of a patient. However, these known access panels either drop down or pivot way from the body of the exam table. These panels provide a space or opening so that a technician or practitioner can more readily perform an exam or procedure on a patient. Typically cardiac exams are performed using these devices. These known access panels create relatively large spaces, and are generally not adjustable in any way. The opening or space is generally static with respect to size.

Generally, many known access panels either drop away quickly or pivot completely out of the way. As a result, their design often provides little or no support for the patient. Furthermore, since they are not completely removed, they can become obstructions for the technician or practitioner. The larger known access panels are cumbersome and generally influence where equipment is located next to the exam table due to interference. Both the patient and practitioner/technician may have uneasiness or anxiety during the exam or procedure as a result.

SUMMARY

Accordingly, the invention was devised in light of the problems described above, the invention is an examination table designed to provide a technician or practitioner easy access to various regions of a patient's body. Specifically, the examination table includes a lower support structure, an upper support structure, and an examination passageway. The upper support structure has a sliding access panel disposed on a side of the upper support structure such that the examination passageway is provided when the sliding access panel is repositioned at various measurements. The sliding access panel also serves as an arm support when the opening is created, which is an improvement over drop away designs.

BRIEF DESCRIPTION OF THE DRAWINGS

The invention will be explained in detail with reference to embodiments, referring to the appended drawings, in which.

DETAILED DESCRIPTION OF THE EMBODIMENT(S)

Figure 1:
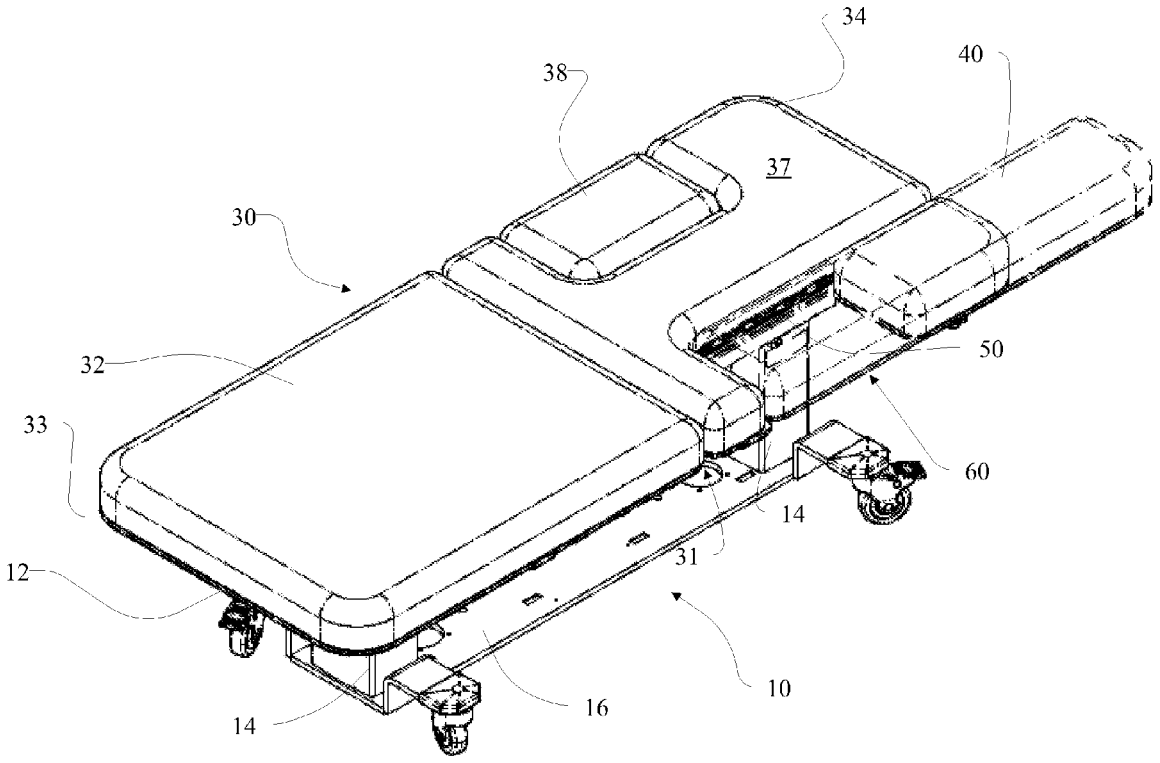
FIG. 1 is a perspective view of an examination table according to the invention.
Figure 2:
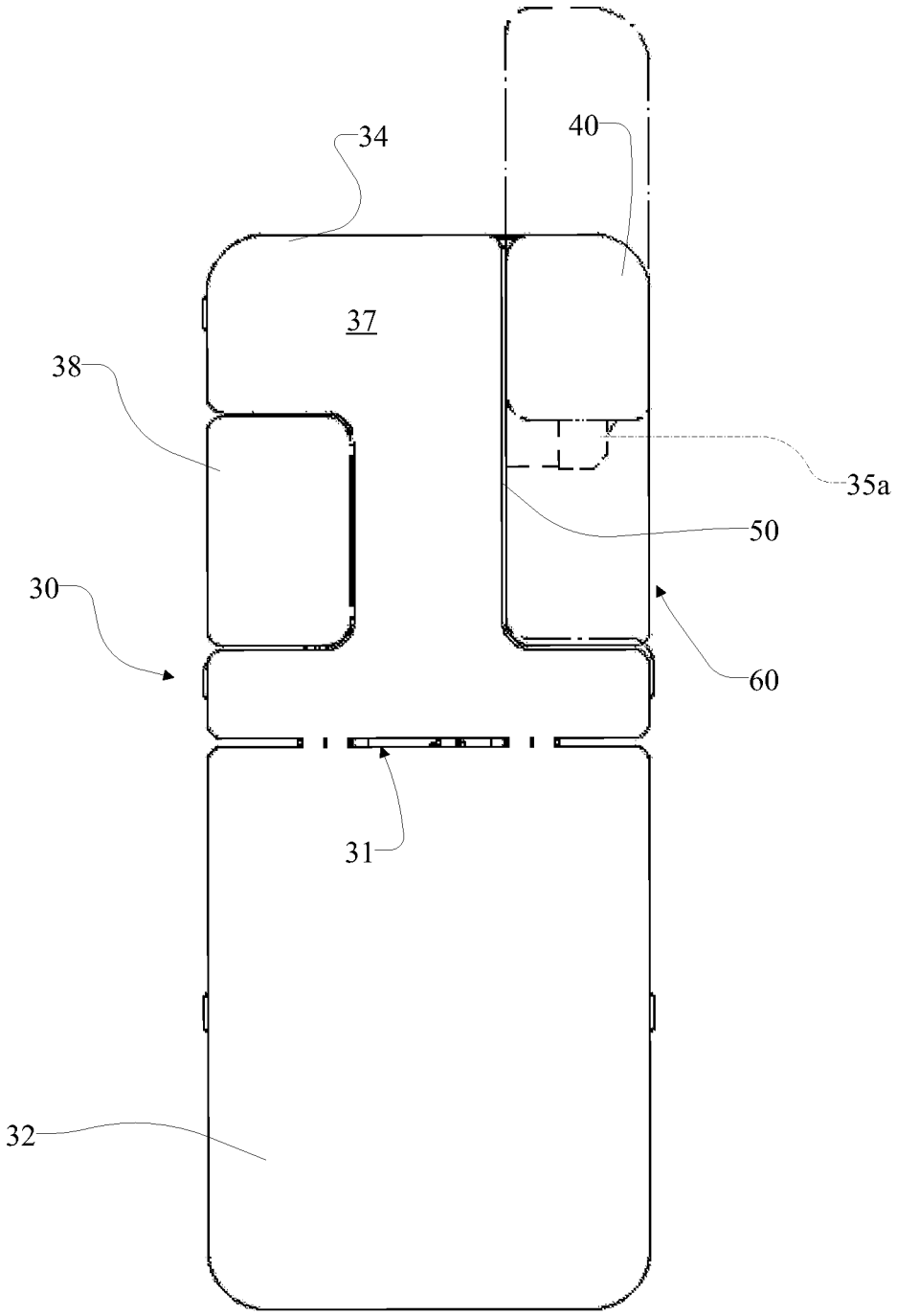
FIG. 2 is a top view of the examination table according to the invention.

The invention will now be described in detail with reference to the figures.

With reference to FIG. 1 through 4, an examination table 1 is shown having a lower support structure 10 and an upper support structure 30.

The lower support structure 10 includes a frame 12, which attaches to the upper support structure 30, support legs 14, and a lateral support frame 16. The frame 12 includes a framework of metal, tubular supports in the embodiment shown. However, any framework or support construction that is capable of supporting the upper support structure 30 may be used. The frame 12 connects to two support legs 14 that extend from the frame 12 to the floor and connect with the lateral support frame 16. The lateral support frame 16 includes wheels that lock in the embodiment shown. However, the examination table 1 could be stationary in other embodiments.

The examination table 1, in the embodiment shown, is adjustable, wherein the upper support structure 30 is adapted to pivot. The upper support structure 30 includes a lower body portion 32 and an upper body portion 34 that meet a substantial middle of the upper support structure 30 with respect to a longitudinal length of the examination table. The lower body portion 32 and upper body portion 34 are constructed to include a support plate 33, 35 positioned to meet with the frame 12 of the lower support structure 10. Additionally, a cushion is provided and attaches to an upper surface of the support plate 33. However, construction and design of the upper support structure 30, notably aesthetic and upholstery may be a matter of design choice. The support plate 33, 35 is rigid and should be strong enough to support a human body without deformation or fracture.

In the embodiment shown, the lower body portion 32 rigidly connect to the frame 12, while the upper body portion 34 is rigidly, pivotally connected to the lower body portion 32 using a pivot mechanism 31, such as a hinge. The upper body portion 34 does not rigidly connect to the frame 12 in the embodiment shown. However, if the examination table 1 is constructed such that the upper support structure 30 is not adjustable with respect to the lower support structure 10, then the upper body portion 34 of the upper support structure rigidly attaches to the frame 12 of the lower support structure 10.

Figure 3:
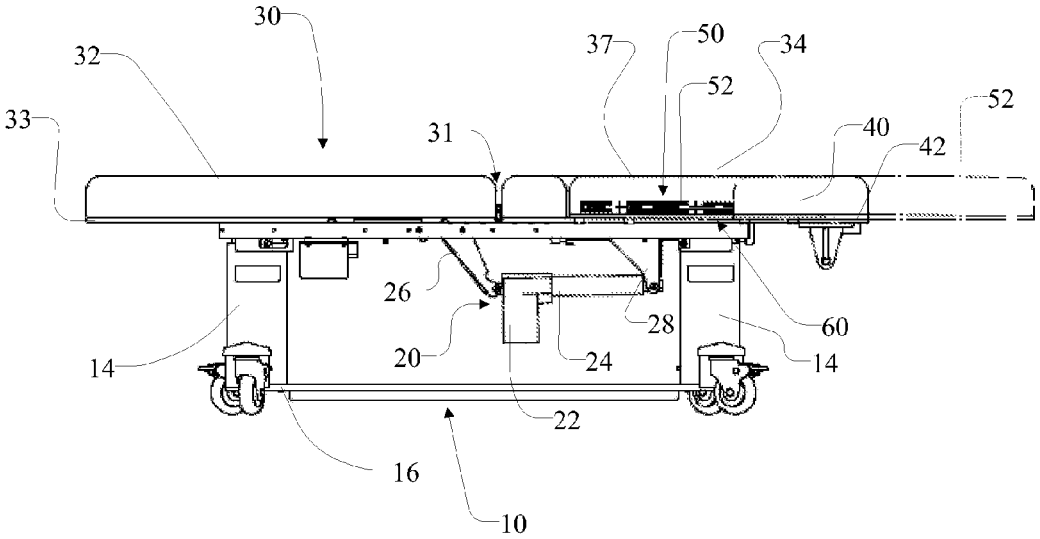
FIG. 3 is a side view of the examination table according to the invention.
Figure 4:
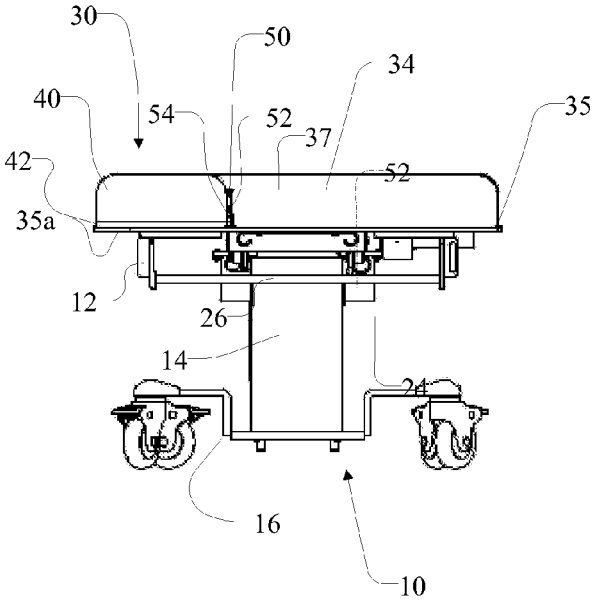
FIG. 4 is a front view of the examination table according to the invention.

As shown in FIG. 3, an adjustment mechanism 20 is provided and includes a motor 22, actuator 24 and two articulating hinges 26, 28. One articulating hinge 26 is rigidly attached to the lower body portion 32, while the other articulating hinge 28 is attached to the upper body portion 34. Each articulating hinges 26, 28 attaches the support plates 33, 35 of the lower and upper body portions 32, 34, respectively. Since the upper body portion 34 is not rigidly attached to the frame 12, the adjustment mechanism 20 can adjust an angle of the upper body portion 34 using the actuator 24 and the articulating hinges 26, 28. However, as discussed, the lower and upper body portions 32, 34 can both be rigidly attached to frame 12 in other embodiments.

The upper body portion 34 includes a main body 37, an articulating access panel 38, and a sliding access panel 40, which connects to the main body through a sliding mechanism 50. The sliding access panel 40 is positioned on a side of the main body 37, while the articulating access panel 38 is positioned on another side of the main body 37 across.

The support plate 35 of the upper body portion 34 is adapted to support the main body 37, but includes a number of open areas such that the support plate 34 remains unobtrusive to any opening or spaces provided by function of the articulating access panel 38 and the sliding access panel 40; notable where the articulating access panel 38 and the sliding access panel 40 are positioned. The support plate 35 does include a support brace 35*a* that is positioned in an area where the sliding access panel 40 is placed when repositioned. As a result, the support brace 35*a* supports the weight of the sliding access panel 40 and a patient's body, if the sliding access panel 40 is used as a support. In the embodiment shown, the support brace 35*a* is just an extension of the of the support plate 35. However, other structure could be added to the support brace 35*a* for additional support, such as a buttress, column, etc.

The articulating access panel 38 is a section of the upper body portion 34 that can pivot away from the main body 37, so that a practitioner or technician can access a patient from underneath the upper body portion 34. The sliding access panel 40 is also a section of the upper support structure 30 that is a separate component, and only connects to the main body 37 through the sliding mechanism 50. The sliding access panel 40 is an elongated section, adapted to slide away from the pivot mechanism 31. The sliding access panel 40 is constructed in the same manner as the other portion of the lower and upper body portions 32, 34, having a support plate 42 and cushion positioned on top. However, the support plate 42 of the sliding access panel 40 further includes a bracket 44 which is then secured to the sliding mechanism 50. The sliding mechanism 50 secures to the support plate 35 of the main body 37, as well.

The sliding mechanism 50 includes a body slide member 52 that is secured to the main body 37 and a panel slide member 54 that secures to the bracket 44 of the sliding access panel 40. The body and panel slide members 52, 54 slide in a longitudinal direction parallel to one another. In the embodiment shown, the body slide member 52 is a housing member that receives a panel slide member 54, which is a track. However, any known mechanism may be used, as long as the sliding mechanism 50 is robust enough to withstand the weight of the sliding access panel 40 and the weight of a patient's body.

Since the support plate 35 includes an opening in this area, when the sliding access panel 40 opens and slides away from the pivot mechanism 31, a practitioner or technician has easy access to the patient through an examination passageway 60. The sliding access panel 40 is adapted to slide away by incremental measurements, and as a result, the examination passageway 60 can be adjusted in order to minimize the area need to perform an examination or procedure. The support brace 35*a* and the sliding mechanism 50 provide the support is a patient is required to lean on the sliding access panel regardless how much the sliding access panel 40 slides away from the pivot mechanism 31. Both the sliding access panel 40 and the articulating access panel 38 can be removed from the upper body portion 34. As a result, these components can be remove from the examination area completely, or used as described above.

In the embodiment shown, the sliding access panel 40 can slide manually by a technician or practitioner by pulling the sliding access panel 40 away from the lower body portion 32. However, it is also possible to incorporate a motor and or actuator in order to mechanically sliding the sliding access panel 40 away from the lower body portion 32. The incremental movement insures adequate support during the transition instead of the sudden loss of support found in the drop away system. It is possible in other embodiments to include more than one sliding access panel 40 disposed in different areas of the table.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An examination table comprising:

a lower support structure;

an upper support structure having an articulating access panel connected to a first side of the upper support structure and rotatable toward the lower support structure, a sliding mechanism transversely opposed to the first side along an outer surface of a second side of the upper support structure, and a sliding access panel connected to the sliding mechanism and extendable along a longitudinal length of the upper support structure; and an unobstructed examination passageway provided between an end of the sliding access panel and a side of the upper support facing the end of the sliding access panel, the unobstructed examination passageway adjustable at different sizes when the sliding access panel is repositioned at various measurements and spanning a transverse distance substantially equal to a width of the sliding access panel.

2. The examination table according to claim 1, wherein the lower support structure includes a frame that attaches to the upper support structure.

3. The examination table according to claim 2, wherein the lower support structure further includes a plurality of support legs that extend from the frame and a lateral support frame that connects to the plurality of support legs, the lateral support frame positioned away from the frame.

4. The examination table according to claim 1, wherein the upper support structure includes a lower body portion and an upper body portion that meet at a substantial middle of the upper support structure with respect to a longitudinal length of the examination table.

5. The examination table according to claim 4, wherein the lower body portion and the upper body portion include a support plate positioned to meet with the lower support structure.

6. The examination table according to claim 5, wherein the lower body portion rigidly connects to the lower support structure and the upper body portion pivotally connects to the lower body portion using a pivot mechanism.

7. The examination table according to claim 6, wherein the upper body portion does not rigidly connect to a frame of the lower support structure.

8. The examination table according to claim 7, further comprising an adjustment mechanism having a motor, an actuator, and a pair of articulating hinges.

9. The examination table according to claim 8, wherein one of the pair of articulating hinges attaches to the lower body portion and another of the pair of articulating hinges attaches to the upper body portion.

10. The examination table according to claim 1, wherein the upper support structure includes a lower body portion and an upper body portion having a main body and the sliding access panel is positioned on a side of the main body.

11. The examination table according to claim 1, wherein the upper body portion includes a support plate having a support brace extending from the support plate and positioned under the sliding access panel.

12. The examination table according to claim 11, wherein the sliding access panel connects to the main body through the sliding mechanism.

13. The examination table according to claim 12, wherein the sliding access panel includes a panel support plate.

14. The examination table according to claim 1, wherein the sliding mechanism includes a body slide member secured to the main body and a panel slide member secured to the sliding access panel.

15. The examination table according to claim 14, wherein the body slide member is a housing member that receives the panel slide member.

16. The examination table according to claim 15, wherein the panel slide member is a track.

17. The examination table according to claim 16, wherein the sliding access panel is adapted to reposition away from the lower body portion by incremental measurements such that a size of the examination passageway can be adjusted.

18. An examination table comprising:

an upper support structure;

a sliding mechanism disposed along an outer surface side running along a longitudinal length of the upper support structure and having a body slide member secured to the upper support structure and a panel slide member connected to the body slide member, the body slide member and the panel slide member slide parallel to one another;

a sliding access panel connected to the panel slide member and extendable along a longitudinal length of the upper support structure away from an end thereof such that the sliding access panel extends beyond a perimeter of the upper support structure; and an adjustable examination passageway provided when the sliding access panel is repositioned at various measurements and positioned between an end of the sliding access panel, the sliding mechanism, and a side of the upper support positioned perpendicular to the sliding mechanism and extending transverse to the outer surface side.

* * * * *